US009213306B2

(12) United States Patent
Morioka et al.

(10) Patent No.: US 9,213,306 B2
(45) Date of Patent: Dec. 15, 2015

(54) CARTRIDGE AND IMAGE FORMING APPARATUS

(71) Applicant: CANON KABUSHIKI KAISHA, Tokyo (JP)

(72) Inventors: Masanari Morioka, Yokohama (JP); Hiroyuki Munetsugu, Yokohama (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/634,956

(22) Filed: Mar. 2, 2015

(65) Prior Publication Data

US 2015/0253723 A1 Sep. 10, 2015

(30) Foreign Application Priority Data

Mar. 10, 2014 (JP) ..... 2014-046204

(51) Int. Cl.
*G03G 21/18* (2006.01)
*G03G 21/16* (2006.01)

(52) U.S. Cl.
CPC ..... *G03G 21/1676* (2013.01); *G03G 21/1825* (2013.01)

(58) Field of Classification Search
CPC ..... G03G 21/1825
See application file for complete search history.

(56) References Cited

U.S. PATENT DOCUMENTS 5,258,811 A * 11/1993 Miyake et al. ..... 399/167
6,704,522 B2 3/2004 Sasago et al.
6,714,746 B2 3/2004 Morioka et al.
6,898,399 B2 5/2005 Morioka et al.
6,937,832 B2 8/2005 Sato et al.
6,963,706 B2 11/2005 Morioka et al.
7,079,787 B2 7/2006 Ogino et al.
7,127,192 B2 10/2006 Batori et al.
7,200,349 B2 4/2007 Sato et al.
7,418,225 B2 8/2008 Morioka et al.
7,509,071 B2 3/2009 Yoshimura et al.
8,135,304 B2 3/2012 Abe et al.
8,160,478 B2 4/2012 Munetsugu et al.
8,165,493 B2 4/2012 Chadani et al.
8,270,876 B2 9/2012 Morioka et al.
8,275,286 B2 9/2012 Ueno et al.
8,280,278 B2 10/2012 Ueno et al.
8,295,734 B2 10/2012 Ueno et al.
8,437,669 B2 5/2013 Morioka et al.

(Continued)

FOREIGN PATENT DOCUMENTS

JP 2007-213025 A 8/2007

*Primary Examiner* — G. M. Hyder
(74) *Attorney, Agent, or Firm* — Fitzpatrick, Cella, Harper & Scinto

(57) ABSTRACT

A cartridge removably mountable to an image forming apparatus, including: a developing unit having a developing roller; two support mechanisms each configured to rotatably support the developing unit by a rotary shaft at an each end of the cartridge; and a biasing member provided on one support mechanism and configured to apply a biasing force to bring the roller into contact with a photosensitive drum, wherein a force against the biasing force is applied to the developing unit to rotate the developing unit to separate the roller from the drum, and in a projection plane orthogonal to the rotary shaft, an action point on which the biasing force acts is arranged between a first line connecting rotation centers of the roller and the drum and a second line passing through the support shaft in parallel with a slide direction of the support shaft slidably supported by the one support mechanism.

20 Claims, 11 Drawing Sheets

(56) References Cited

U.S. PATENT DOCUMENTS

| | | | |
|---|---|---|---|
| 8,452,210 | B2 | 5/2013 | Ueno et al. |
| 8,472,840 | B2 | 6/2013 | Abe et al. |
| 8,532,533 | B2 | 9/2013 | Ueno et al. |
| 8,559,849 | B2 | 10/2013 | Suzuki et al. |
| 8,583,001 | B2 | 11/2013 | Kubo et al. |
| 8,630,564 | B2 | 1/2014 | Ueno et al. |
| 8,676,090 | B1 | 3/2014 | Ueno et al. |
| 8,682,215 | B1 | 3/2014 | Ueno et al. |
| 8,688,008 | B2 | 4/2014 | Norioka et al. |
| 9,025,998 | B2 | 5/2015 | Morioka et al. |
| 2013/0209137 | A1 | 8/2013 | Hayashi et al. |
| 2013/0287437 | A1 | 10/2013 | Miyabe et al. |
| 2013/0308971 | A1 | 11/2013 | Kashiide et al. |
| 2014/0056613 | A1 | 2/2014 | Ueno et al. |
| 2014/0064783 | A1 | 3/2014 | Ueno et al. |
| 2014/0064784 | A1 | 3/2014 | Hayashi et al. |
| 2014/0072327 | A1 | 3/2014 | Hayashi et al. |
| 2014/0072339 | A1* | 3/2014 | Munetsugu et al. ..... 399/113 |
| 2014/0147168 | A1 | 5/2014 | Morioka et al. |

* cited by examiner

CARTRIDGE AND IMAGE FORMING APPARATUS

BACKGROUND OF THE INVENTION

1. Field of the Invention

The present invention relates to a cartridge and an image forming apparatus.

2. Description of the Related Art

Hitherto, in image forming apparatus using an electrophotographic image forming process, there has been employed a process cartridge system in which photosensitive drums as image bearing members and developing rollers as developer carrying members are removable from an image forming apparatus main body. This process cartridge system allows users themselves to perform maintenance of the apparatus without an assist from service engineers. Thus, this process cartridge system has been widely used in image forming apparatus.

In this system, during image formation, the developing rollers are biased with a predetermined pressure toward the photosensitive drums. In this state, in a contact development system in which development is performed by bringing the developing rollers into contact with the photosensitive drums, elastic layers of the developing rollers are brought into contact with surfaces of the photosensitive drums with a predetermined pressure. Thus, when the process cartridges mounted to the image forming apparatus main body are not used over a long period of time, the elastic layers of the developing rollers may be deformed. As a result, a density unevenness of images may occur at the time of development.

Further, the developing rollers are held in contact with the photosensitive drums, and hence developer adhering to the developing rollers may be unnecessarily transferred onto the photosensitive drums. In addition, also when the photosensitive drums and the developing rollers are rotated in contact and rubbed against each other without performing development, deterioration of the photosensitive drums, the developing rollers, and the developer may be deteriorated.

In view of the circumstances, there has been proposed an image forming apparatus including a mechanism configured to act on the process cartridges so as to separate the photosensitive drums and the developing rollers apart from each other in the state in which image formation is not performed (Japanese Patent Application Laid-Open No. 2007-213025). In a longitudinal direction of each of the photosensitive drums of this image forming apparatus, a separation mechanism (part of the apparatus main body, which applies a force for separating the developing roller from the photosensitive drum) is provided on one end side, and an abutment mechanism (a mechanism configured to bring the developing roller into contact with the photosensitive drum) is provided on another end side.

However, in the related-art arrangement of the abutment mechanism (such as a pressurizing spring), a great force may be required for separating the developing roller apart from the photosensitive drum.

According to Japanese Patent Application Laid-Open No. 2007-213025, as illustrated in FIG. 12, a force of a pressurizing spring 203 is applied in the direction "h" about a rocking center 205 of a developing unit. This force causes the developing unit to rock, thereby bringing a developing roller 202 into contact with a photosensitive drum 201. Meanwhile, when a force from a mechanism of the apparatus main body is received by a receiving member 204, a force in a direction reverse to the direction "h" needs to be applied about the rocking center 205 against the force of the pressurizing spring 203. When the force in the reverse direction is greater, a motor with higher output needs to be selected as a drive source. As a result, increase in cost and size of the apparatus main body may occur.

In a cartridge including an abutment and separation mechanism for the photosensitive drum and the developing roller, there is a demand to reduce a force that is necessary for separating the photosensitive drum and the developing roller apart from each other.

SUMMARY OF THE INVENTION

In view of the above-mentioned problem, a configuration disclosed in one embodiment of the present application is attained by improving the above-mentioned related art. As a representative configuration disclosed in the one embodiment of the present application, there is provided a cartridge removably mountable to a main body of an image forming apparatus, the cartridge comprising:

a developing unit having a developing roller configured to perform development in contact with a photosensitive drum;

two support mechanisms each configured to rotatably support the developing unit by a rotary shaft at an each end of both ends of the cartridge in a direction parallel to a rotary shaft of the developing roller; and a biasing member provided on a same side as one of the two support mechanisms with respect to the developing unit, the biasing member being configured to apply a biasing force to the developing unit so as to bring the developing roller into contact with the photosensitive drum, wherein, when a force against the biasing force is applied to the developing unit, the developing unit is rotated about the support shaft so that the developing roller is separated from the photosensitive drum, wherein the one of the two support mechanisms has a bearing configured to hold the support shaft in a manner that the support shaft is slidable in a plane orthogonal to the support shaft, and wherein, in a projection plane, onto which structural members of the cartridge are projected, orthogonal to the rotary shaft of the developing roller, an action point at which the biasing force of the biasing member acts on the developing unit is arranged in a region between a first straight line connecting a rotation center of the developing roller and a rotation center of the photosensitive drum, and a second straight line passing through the support shaft and being parallel to a slide direction of the support shaft.

Further features of the present invention will become apparent from the following description of exemplary embodiments with reference to the attached drawings.

DESCRIPTION OF THE EMBODIMENTS

Now, an exemplary embodiment will be described in detail with reference to the accompanying drawings. Note that, dimensions, materials, shapes, relative positional relationships, and the like of components described in the embodiment may be changed as appropriate in accordance with structures or various conditions of apparatus to which the present invention is applied. In other words, the scope of the present invention may not be limited to the embodiment described below.

The present invention relates to an image forming apparatus (electrophotographic image forming apparatus) using an electrophotographic printing method, and to a developing device and a process cartridge that are used therein. Note that, the electrophotographic image forming apparatus refers to an apparatus configured to form images onto recording materials by using an electrophotographic printing method. Examples of the electrophotographic image forming apparatus include a copying machine, a printer (such as a laser beam printer and an LED printer), a facsimile machine, and a word processor. The process cartridge (cartridge) refers to a cartridge into which an electrophotographic photosensitive member (hereinafter referred to as "photosensitive drum") as an image bearing member and at least one of process units configured to act on the photosensitive drum are integrated. The cartridge is removably mountable to a main body of the electrophotographic image forming apparatus. Examples of the process units include a charging unit, a developing unit, and a cleaning member. The developing device refers to a device to be used for developing a latent image on the photosensitive drum. The developing device may serve as a part of the process cartridge, or independently serve as the cartridge (developing cartridge) itself that is removably mountable to the main body of the electrophotographic image forming apparatus. It is preferred that, as described below, the cartridge (developing cartridge) in this case include a developing device 4, a drive-side cover member 124, and a non-drive-side cover member 125. The developing device is configured to perform a developing action in contact with or in the vicinity of the photosensitive drum. In a state in which image formation is not performed prior to use, or during storage, the developing device is kept away from the photosensitive drum unlike at the time of the developing action.

EMBODIMENT

(1) Overall Structure and Operation of Image Forming Apparatus

Figure 2:
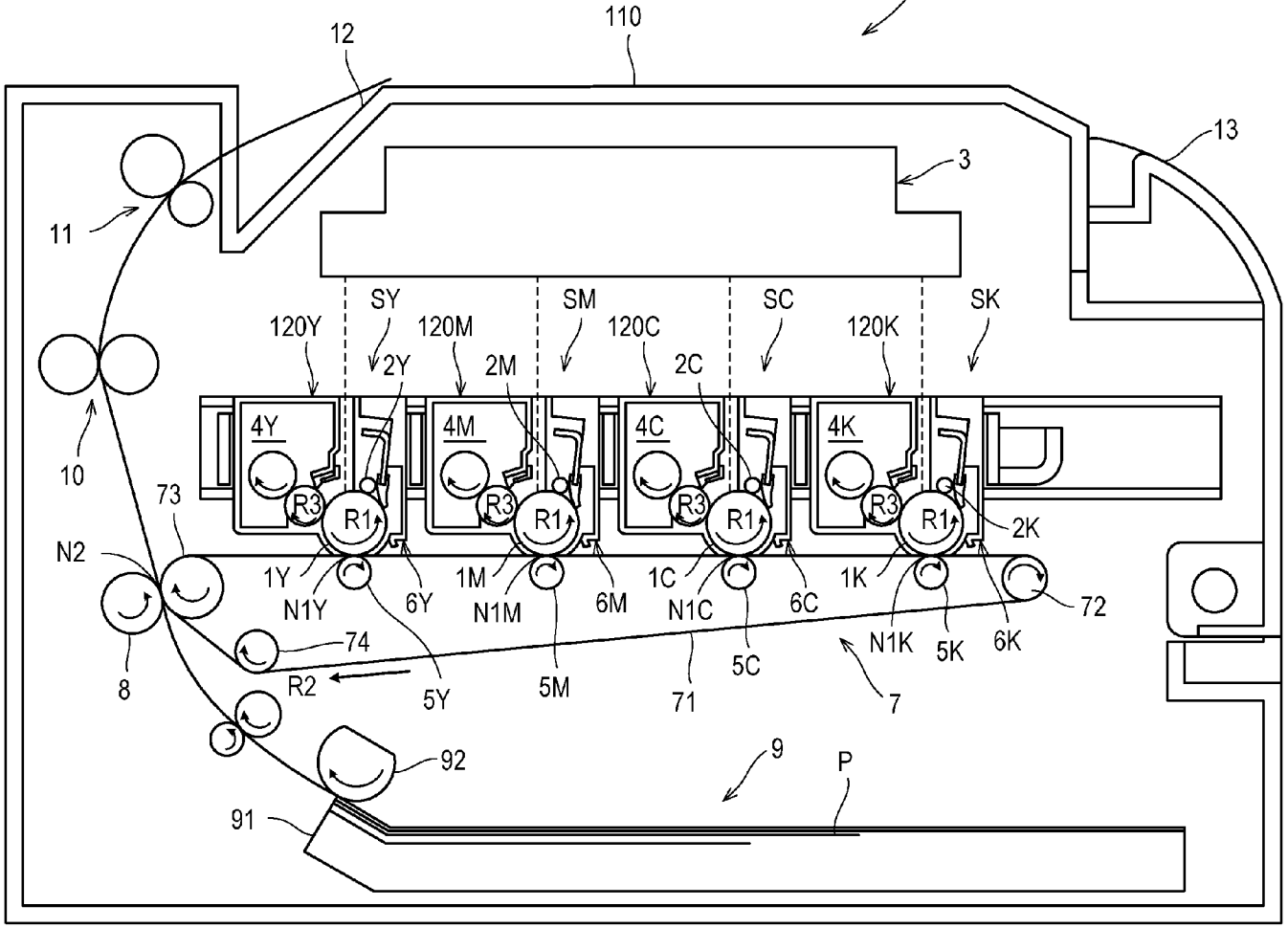
FIG. 2 is a schematic sectional view of an image forming apparatus according to the embodiment.

First, an overall structure and operation of an image forming apparatus according to the embodiment will be described with reference to FIG. 2. FIG. 2 is a schematic sectional view of an image forming apparatus 100 according to the embodiment.

The image forming apparatus 100 according to the embodiment is a laser beam printer configured to form full-color images onto recording media (hereinafter referred to as "recording materials") P such as paper by using an electrophotographic process.

The image forming apparatus 100 according to the embodiment includes, as a plurality of image forming portions, a first image forming portion (station) SY, a second image forming portion (station) SM, a third image forming portion (station) SC, and a fourth image forming portion (station) SK. The first image forming portion SY, the second image forming portion SM, the third image forming portion SC, and the fourth image forming portion SK respectively form images of yellow (Y), magenta (M), cyan (C), and black (K).

In the embodiment, the first image forming portion SY, the second image forming portion SM, the third image forming portion SC, and the fourth image forming portion SK each have substantially the same configuration and perform substantially the same operation, and are different from each other only in color of toner to be used as developer. Thus, unless otherwise distinguished, suffixes Y, M, C, and K indicating correspondences to respective colors are omitted, and the image forming portions are comprehensively described.

Note that, in the image forming apparatus 100 according to the embodiment, a right side in FIG. 2, on which an apparatus openable and closable door 13 is provided, is referred to as the front (front surface), and a surface on the opposite side of the front is referred to as the rear (rear surface). Further, with respect to the front of the image forming apparatus 100, a right side is defined as a drive side, and a left side is defined as a non-drive side.

The image forming apparatus 100 according to the embodiment employs a process cartridge system. Process cartridges 120 are mounted in a removable manner to the main body (hereinafter referred to as the apparatus main body) 110 of the image forming apparatus 100. With this, images can be formed onto the recording materials P.

In the apparatus main body 110, a first process cartridge 120Y, a second process cartridge 120M, a third process cartridge 120C, and a fourth process cartridge 120K are arranged substantially in a horizontal direction. The first process cartridge 120Y, the second process cartridge 120M, the third process cartridge 120C, and the fourth process cartridge 120K each have a similar electrophotographic process mechanism, and respectively contain toners of different colors.

A rotational driving force is transmitted from a drive output portion (not shown) of the apparatus main body 110 to the process cartridge 120. Further, a bias voltage (such as charging bias and developing bias) is supplied from a bias power source (not shown) of the apparatus main body 110 to the process cartridge 120.

Figure 3:
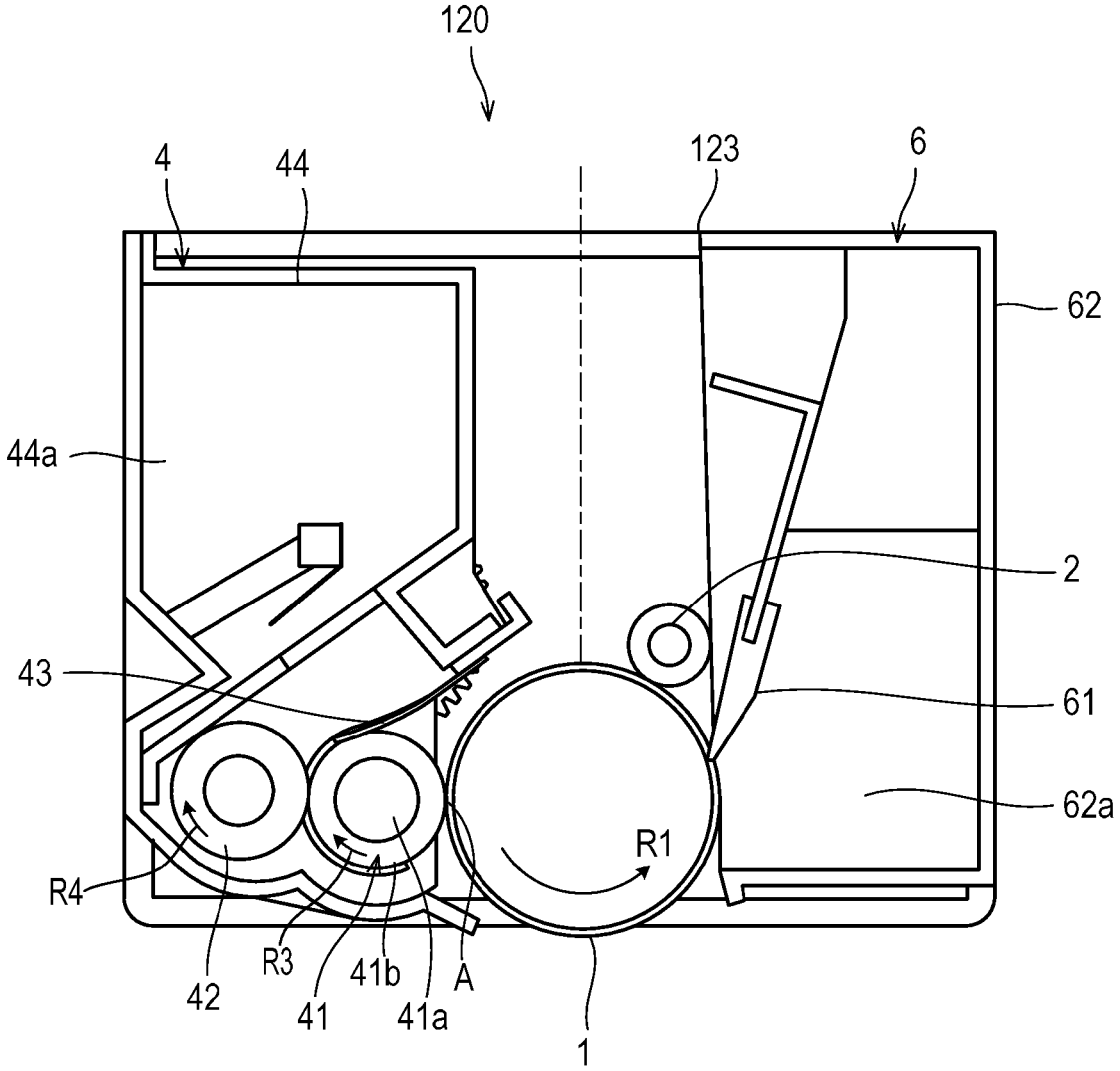
FIG. 3 is a schematic sectional view of a process cartridge according to the embodiment.

FIG. 3 is a schematic sectional view of the process cartridge 120 according to the embodiment.

The process cartridge 120 according to the embodiment includes a photosensitive drum 1 as a drum-shaped photosensitive member and process units to act on the photosensitive drum 1. In the embodiment, the photosensitive drum 1 is an organic photosensitive drum having a photosensitive layer made of an organic photoconductor (OPC). Further, in the embodiment, the process cartridge 120 includes, as the process units, the charging unit, the developing unit, and the cleaning member. Specifically, a charging roller 2 as a roller-shaped charging member is provided as the charging unit. Further, a cleaning blade 61 is provided as the cleaning member, and the developing device 4 including a developing roller 41 as a roller-shaped developer carrying member is provided as the developing unit. The developing device 4 further includes a supply roller 42 as a developer supply member and a developing blade 43 as a developer regulating member. More specific configuration of the process cartridge 120 will be described below.

The first process cartridge 120Y contains a toner of yellow (Y) in a developing frame 44 so as to form a toner image of yellow onto the surface of the photosensitive drum 1. The second process cartridge 120M contains a toner of magenta (M) in the developing frame 44 so as to form a toner image of magenta onto the surface of the photosensitive drum 1. The third process cartridge 120C contains a toner of cyan (C) in the developing frame 44 so as to form a toner image of cyan onto the surface of the photosensitive drum 1. The fourth process cartridge 120K contains a toner of black (K) in the developing frame 44 so as to form a toner image of black onto the surface of the photosensitive drum 1.

In the apparatus main body 110, a laser scanner unit 3 as an exposure unit is provided above the first process cartridge 120Y, the second process cartridge 120M, the third process cartridge 120C, and the fourth process cartridge 120K. This laser scanner unit 3 outputs laser beams in accordance with image information. Those laser beams pass through exposure window portions 123 of the process cartridges 120 so as to scan and expose the surfaces of the photosensitive drums 1.

Further, in the apparatus main body 110, an intermediate transfer unit 7 is arranged so as to face the first process cartridge 120Y, the second process cartridge 120M, the third process cartridge 120C, and the fourth process cartridge 120K (in the embodiment, below the process cartridges 120). The intermediate transfer unit 7 includes an intermediate transfer belt 71, which is a flexible endless-belt, as an intermediate transfer member. The intermediate transfer belt 71 is passed over a drive roller 72, a turn roller 73, and a tension roller 74 that are provided as a plurality of support rollers. The photosensitive drums 1 of the process cartridges 120 are arranged so as to abut against the intermediate transfer belt 71. With this, primary transfer portions (contact portions) N1 are formed between the photosensitive drums 1 and the intermediate transfer belt 71.

On an inner peripheral surface side of the intermediate transfer belt 71, primary transfer rollers 5, which are roller-shaped transfer members, are provided as primary transfer members so as to face the photosensitive drums 1. The primary transfer rollers 5 are arranged so as to abut against the photosensitive drums 1 through intermediation of the intermediate transfer belt 71. Further, a secondary transfer roller 8, which is a roller-shaped transfer member, is arranged as a secondary transfer member so as to abut against the turn roller 73 through intermediation of the intermediate transfer belt 71. With this, a secondary transfer portion (contact portion) N2 is formed between the intermediate transfer belt 71 and the secondary transfer roller 8.

A feeding unit 9 is provided on an upstream side with respect to the secondary transfer portion N2 in a conveying direction of the recording materials P (in the embodiment, provided below the intermediate transfer unit 7). The feeding unit 9 includes a feed tray 91 in which the recording materials P are contained and stacked, and a feed roller 92. A fixing unit 10 as a fixing device and a delivery unit 11 are provided on a downstream side with respect to the secondary transfer portion N2 in the conveying direction of the recording materials P (in the embodiment, provided on an upper part on the rear side in the apparatus main body 110). A delivery tray 12 is provided on an upper surface of the apparatus main body 110.

(2) Image Forming Operation

As an example of an image forming operation, an operation of forming a full-color image will be described with reference to FIG. 2.

The photosensitive drums 1 of the process cartridges 120 are each driven to rotate in a direction indicated by the arrow R1 in FIG. 2 at a predetermined speed (circumferential speed). Simultaneously, the intermediate transfer belt 71 is also driven to rotate in a direction indicated by the arrow R2 in FIG. 2 at a speed (circumferential speed) in accordance with the speed (circumferential speed) of the photosensitive drums 1 so that, at the primary transfer portions N1, a surface of the intermediate transfer belt 71 is moved in the same direction (forward direction) as that of the surfaces of the photosensitive drums 1.

Next, the laser scanner unit 3 is driven. In synchronization with the driving of the laser scanner unit 3, in each of the process cartridges 120, the charging roller 2 uniformly charges the surface of the photosensitive drum 1 with a predetermined polarity and electric potential. Then, the laser scanner unit 3 scans and exposes the surfaces of the photosensitive drums 1 with laser beams in accordance with image signals of the respective colors. In this way, latent images (electrostatic images, or electrostatic latent images) corresponding to the image signals of the respective colors are formed on the surfaces of the photosensitive drums 1.

The latent images formed on the photosensitive drums 1 are developed into toner images using the toners supplied from the developing rollers 41 of the developing devices 4. Note that, the developing rollers 41 are each driven to rotate at a predetermined speed (circumferential speed) in a direction indicated by the arrow R3 in FIG. 2.

By the electrophotographic image forming process as described above, a yellow toner image corresponding to a yellow component of the full-color image is formed on the photosensitive drum 1 of the first process cartridge 120Y. Then, the toner image is primarily transferred onto the intermediate transfer belt 71 by action of the primary transfer roller 5Y. Similarly, a magenta toner image corresponding to a magenta component of the full-color image is formed on the photosensitive drum 1 of the second process cartridge 120M. Then, the toner image is primarily transferred in a superimposed manner onto the yellow toner image that has already been transferred onto the intermediate transfer belt 71. Similarly, a cyan toner image corresponding to a cyan component of the full-color image is formed on the photosensitive drum 1 of the third process cartridge 120C. Then, the toner image is primarily transferred in a superimposed manner onto the yellow and magenta toner images that have already been transferred onto the intermediate transfer belt 71. Similarly, a black toner image corresponding to a black component of the full-color image is formed on the photosensitive drum 1 of the fourth process cartridge 120K. Then, the toner image is primarily transferred in a superimposed manner onto the yellow, magenta, and cyan toner images that have already been transferred onto the intermediate transfer belt 71.

In this way, an unfixed toner image of the full-color image formed of the four-color toner images of yellow, magenta, cyan, and black is formed on the intermediate transfer belt 71.

Meanwhile, in the feeding unit 9, the recording materials P are separated one by one and fed at a predetermined control timing. At the predetermined control timing, those recording materials P are each guided into the secondary transfer portion N2 as a contact portion between the secondary transfer roller 8 and the intermediate transfer belt 71.

With this, the recording material P is conveyed through the secondary transfer portion N2, and simultaneously, the four-color toner images that are superimposed on each other on the intermediate transfer belt 71 are secondarily transferred sequentially onto the recording materials P in a collective manner.

Then, the recording material P bearing the unfixed toner image is conveyed to the fixing unit 10. Next, the toner images on the recording material P are fixed by the fixing unit 10, and the recording material P is then delivered onto the delivery tray 12. Toner remaining on the photosensitive drums 1 after the primary transfer step (after-primary-transfer residual toner) is removed and collected from the surfaces of the photosensitive drums 1 by the cleaning blades 61 provided in cleaning units 6.

(3) Configuration of Process Cartridge

Figure 4:
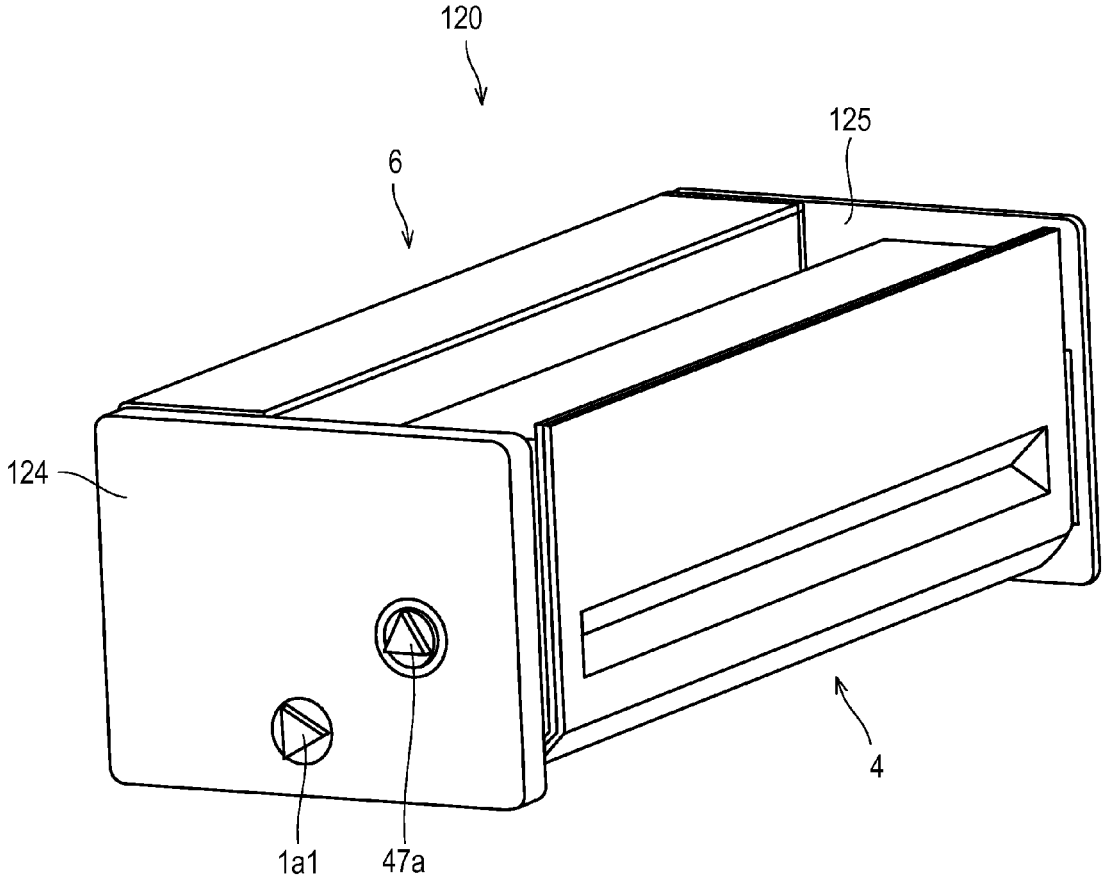
FIG. 4 is a schematic perspective view of the process cartridge according to the embodiment.

Next, a configuration of the process cartridge according to the embodiment will be described with reference to FIGS. 3 and 4. FIG. 4 is a schematic perspective view of the process cartridge 120 according to the embodiment.

The process cartridge 120 is formed so as to extend longitudinally in a horizontal direction along a rotation axis direction of the photosensitive drum 1. In a state in which the process cartridge 120 is mounted to the apparatus main body 110, one side of the process cartridge 120 in the longitudinal direction corresponds to the drive side, and another side thereof corresponds to the non-drive side. The process cartridge 120 includes the cleaning unit 6, the developing unit (developing device 4), the drive-side cover member 124, and the non-drive-side cover member 125. The cleaning unit 6 and the developing device 4 are coupled with each other.

The cleaning unit 6 includes the photosensitive drum 1, the charging roller 2, and the cleaning blade 61. The photosensitive drum 1, the charging roller 2, and the cleaning blade 61 are mounted to a cleaning container (cleaning frame) 62 as a frame which forms a waste toner containing portion 62*a*.

The charging roller 2 is in contact with the surface of the photosensitive drum 1, and is rotated in association with rotation of the photosensitive drum 1. Then, the charging roller 2 charges the surface of the photosensitive drum 1 with the supplied charging bias.

The cleaning blade 61 is fixed to the cleaning container 62. The cleaning blade 61 is arranged so that an elastic rubber portion at a distal end thereof (free end in a transverse direction) abuts against the photosensitive drum 1 in a counter direction to the rotation direction of the photosensitive drum 1. At the time of image formation, the cleaning blade 61 cleans the surface of the photosensitive drum 1 by scraping off the after-transfer residual toner remaining on the rotated photosensitive drum 1. The cleaning blade 61 is arranged so that the distal end thereof abuts against the surface of the photosensitive drum 1 with a predetermined pressure, to thereby more reliably scrape off the after-transfer residual toner.

After the after-transfer residual toner is scraped off from the surface of the photosensitive drum 1 by the cleaning blade 61, the after-transfer residual toner is collected as waste toner into the waste toner containing portion 62*a* formed in the cleaning container 62.

(4) Configuration of Developing Device

Next, a configuration of the developing device according to the embodiment will be described with reference to FIGS. 3 and 5.

Figure 5:
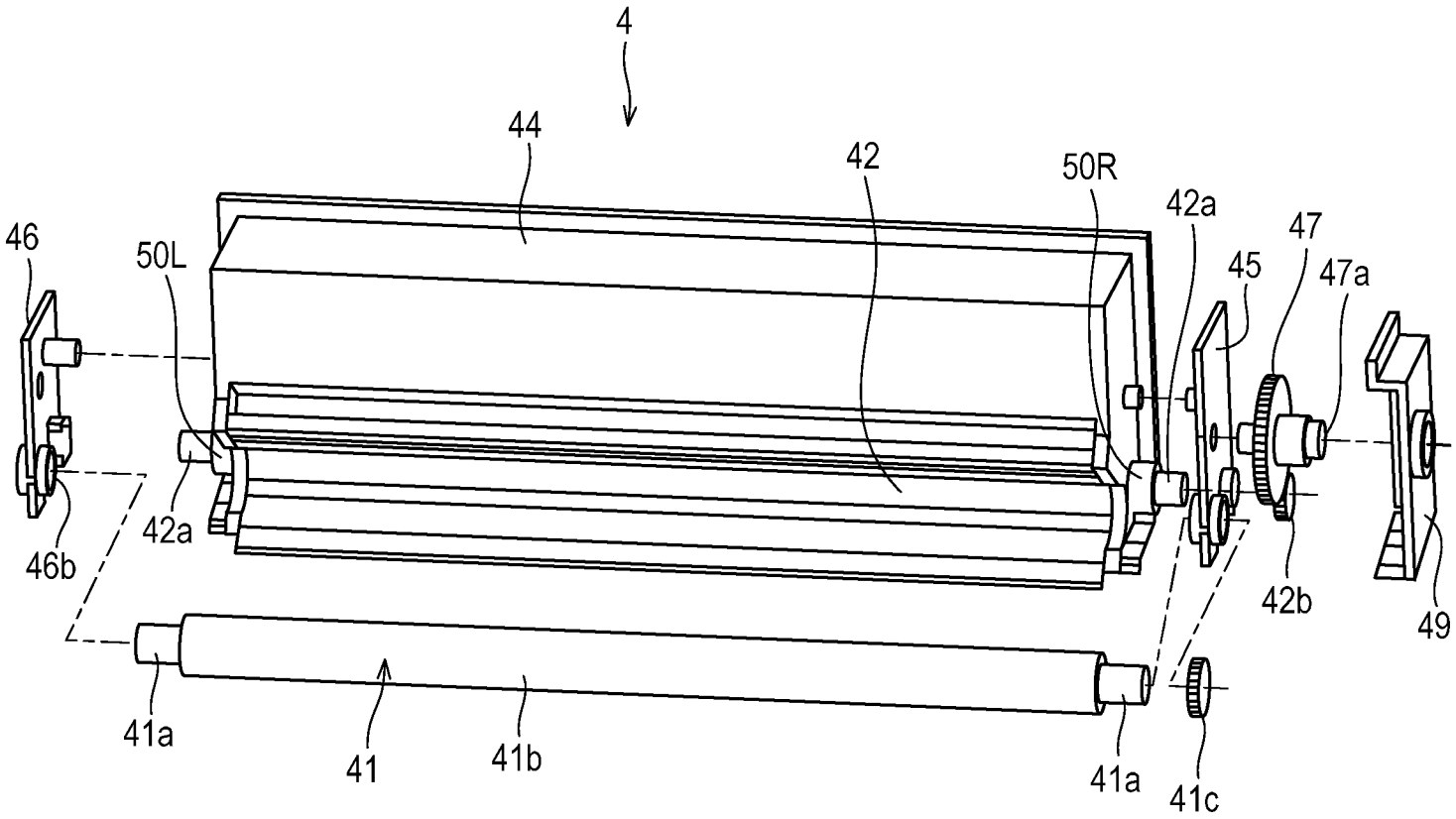
FIG. 5 is an exploded perspective view of the developing device according to the embodiment.

FIG. 5 is an exploded perspective view of the developing device 4 according to the embodiment.

The developing device 4 is formed into an oblong shape of which a longitudinal direction is a rotation axis direction (rotary shaft direction) of the developing roller 41. In a state in which the developing device 4 is arranged in the apparatus main body 110, one side of the developing device 4 in the longitudinal direction corresponds to the drive side, and another side thereof corresponds to the non-drive side.

The developing roller 41 and the supply roller 42 are mounted to the developing frame 44 forming a toner containing portion 44*a*. Both ends of a rotary shaft 41*a* of the developing roller 41 are supported in a freely rotatable manner respectively by a drive-side bearing member 45 and a non-drive-side bearing member 46 mounted to a drive-side end and a non-drive-side end of the developing frame 44. Similarly, both ends of a rotary shaft 42*a* of the supply roller 42 are supported in a freely rotatable manner respectively by the drive-side bearing member 45 and the non-drive-side bearing member 46. The drive-side bearing member 45 and the non-drive-side bearing member 46 are fixed integrally to the developing frame 44.

In the embodiment, in the developing roller 41, an elastic layer 41*b* having an appropriate conductivity is formed around the rotary shaft (core member or metal core) 41*a* made of a metal such as stainless steel. The elastic layer 41*b* is made of a rubber material. Examples of the rubber material include a silicon rubber, a urethane rubber, an acrylic rubber, a natural rubber, and an ethylene propylene diene rubber (EPDM). An electrical resistance value of the elastic layer 41*b* can be adjusted by dispersing carbon particles, carbon resin particles, metal particles, an ion conductive agent, and the like.

On an outside with respect to the drive-side bearing member 45 of the developing device 4 in the longitudinal direction, a developing roller gear 41*c* is mounted to the drive-side end of the rotary shaft 41*a* of the developing roller 41. Similarly, on the outside with respect to the drive-side bearing member 45 of the developing device 4 in the longitudinal direction, a supply roller gear 42*b* is mounted to the drive-side end of the rotary shaft 42*a* of the supply roller 42. The developing roller gear 41*c* and the supply roller gear 42*b* mesh with a developing drive input gear 47 as a drive transmission portion that is supported in a freely rotatable manner by the drive-side bearing member 45.

The developing drive input gear 47 includes a drive input coupling 47*a*. This drive input coupling 47*a* is engaged with a drive output coupling (not shown) on the apparatus main body 110 so that a driving force of a drive motor (not shown) of the apparatus main body 110 is transmitted to the developing drive input gear 47. With this, the driving force is transmitted to the developing roller 41 and the supply roller 42 through intermediation of the developing roller gear 41*c* and the supply roller gear 42*b*, and the developing roller 41 and the supply roller 42 are driven to rotate at predetermined speeds. The developing roller 41 is driven to rotate in the direction indicated by the arrow R3 in FIG. 3, and the supply roller 42 is driven to rotate in a direction indicated by the arrow R4 in FIG. 3. The developing roller 41 and the supply roller 42 are held in contact with each other, and surfaces thereof are moved in mutually reversed directions at a contact portion therebetween.

The developing blade 43 is an elastic thin metal plate having a thickness of approximately 0.1 mm. The developing blade 43 is arranged so that a distal end thereof (free end in the transverse direction) abuts against the developing roller 41 in a counter direction to the rotation direction of the developing roller 41.

At a drive-side end of the developing device 4 in the longitudinal direction, a drive-side supply roller shaft seal (hereinafter referred to as "drive-side seal") 50R is mounted to an exposed part of the rotary shaft 42*a* of the supply roller 42, which is exposed to an outside of the developing frame 44. Further, at a non-drive-side end of the developing device 4 in the longitudinal direction, a non-drive-side supply roller shaft seal (hereinafter referred to as "non-drive-side seal") 50L is mounted to another exposed part of the rotary shaft 42*a* of the supply roller 42, which is exposed to the outside of the developing frame 44. With this, toner leakage through gaps between the developing frame 44 and the rotary shaft 42*a* is prevented.

At the time of image formation, the developing roller 41 and the supply roller 42 are driven as described above so that the supply roller 42 and the developing roller 41 rub against each other while being rotated. With this, the toner in the developing frame 44 is carried on the developing roller 41.

The developing blade 43 is configured to regulate a thickness of a toner layer formed on a peripheral surface of the developing roller 41 and to give an electrical charge to the toner by an abutment pressure against the developing roller 41 that causes triboelectric charging between the developing blade 43 and the developing roller 41.

Then, at a contact portion A between the developing roller 41 and the photosensitive drum 1, the electrically charged toner on the developing roller 41 adheres onto the latent image on the photosensitive drum 1. With this, the latent image on the photosensitive drum 1 is developed into a toner image.

(5) A Method of Coupling Cleaning Unit and Developing Device with Each Other Next, a method of coupling the cleaning unit 6 and the developing device 4 with each other according to the embodiment will be described with reference to FIGS. 6 and 7.

Figure 6:
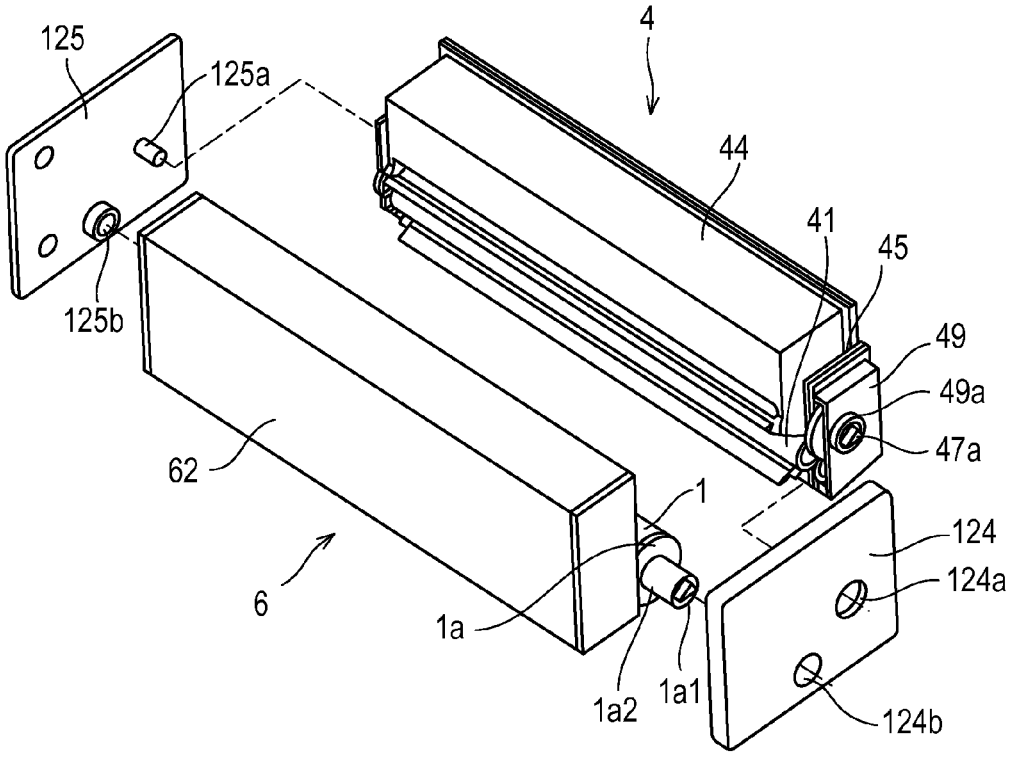
FIG. 6 is a schematic perspective view illustrating a method of coupling a cleaning unit and the developing device with each other according to the embodiment.
Figure 7:
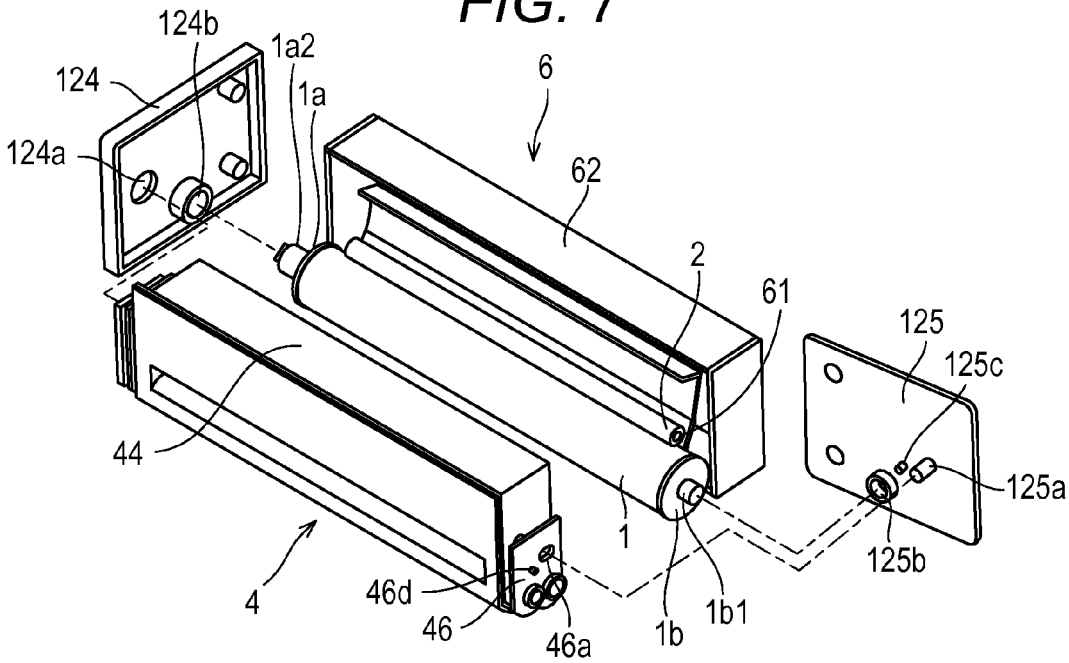
FIG. 7 is another schematic perspective view illustrating the method of coupling the cleaning unit and the developing device with each other according to the embodiment.

FIGS. 6 and 7 are each a schematic perspective view illustrating the method of coupling the cleaning unit 6 and the developing device 4 with each other according to the embodiment. FIG. 6 is a schematic perspective view as viewed from the drive side of the process cartridge 120 in the longitudinal direction. FIG. 7 is another schematic perspective view as viewed from the non-drive side of the process cartridge 120 in the longitudinal direction.

A drive-side end member 1*a* is mounted to a drive-side end of the photosensitive drum 1 in the longitudinal direction. The drive-side end member 1*a* includes a drive input coupling 1*a*1 and a shaft portion 1*a*2. The drive input coupling 1*a*1 is engaged with the drive output coupling (not shown) on the apparatus main body 110, and receives the driving force of the drive motor (not shown) of the apparatus main body 110. Further, a non-drive-side end member 1*b* is mounted to a non-drive-side end of the photosensitive drum 1 in the longitudinal direction. This non-drive-side end member 1*b* includes a shaft portion 1*b*1.

The drive-side cover member 124 supports the shaft portion 1*a*2 of the drive-side end member 1*a* in a rotatable manner with a drive-side photosensitive drum bearing portion 124*b*. The non-drive-side cover member 125 supports the shaft portion 1*b*1 of the non-drive-side end member 1*b* in a rotatable manner with a non-drive-side photosensitive drum bearing portion 125*b*. The drive-side cover member 124 and the non-drive-side cover member 125 are fixed to the cleaning container 62.

A gear holding member 49 fixed integrally to the developing frame 44 is provided at the drive-side end of the developing device 4 in the longitudinal direction. The gear holding member 49 is fixed integrally to the developing frame 44 together with the drive-side bearing member 45 configured to support the developing roller 41 and the supply roller 42. Further, at the non-drive-side end of the developing device 4 in the longitudinal direction, the non-drive-side bearing member 46 configured to support the developing roller 41 and the supply roller 42 is fixed integrally to the developing frame 44.

The gear holding member 49 supports, together with the drive-side bearing member 45 in a rotatable manner, the developing drive input gear 47 including the above-mentioned drive input coupling 47*a* configured to receive the driving force from the apparatus main body 110 to the developing device 4 (FIG. 6). A cylindrical support shaft (support mechanism) 49*a* is provided on a side surface of the gear holding member 49, which is positioned on the outside of the developing device 4 in the longitudinal direction. The support shaft 49*a* is fitted into a support hole 124*a* of the drive-side cover member 124. With this, the gear holding member 49 is supported in a rotatable manner by the drive-side cover member 124.

An oblong hole (elongated hole, groove-shaped portion) 46*a* as a bearing is formed through a side surface of the non-drive-side bearing member 46, which is positioned on the outside of the developing device 4 in the longitudinal direction. A cylindrical support shaft 125*a* of the non-drive-side cover member 125 is fitted into the oblong hole 46*a*. With this, the non-drive-side bearing member 46, that is, the developing device 4 is supported in a rotatable and slidable manner by the non-drive-side cover member 125. A longitudinal direction of the oblong hole 46*a* corresponds to a slidable direction (slide direction) of the developing device 4. Note that, the support shaft 125*a* and the oblong hole 46*a* correspond to a support mechanism. In other words, the oblong hole 46*a* allows the support shaft 125*a* to be held in a slidable manner in a plane orthogonal to the support shaft 125*a*.

In this way, the developing device 4 is supported in a rotatable (rockable) manner by the drive-side cover member 124 and the non-drive-side cover member 125, or supported in a slidable manner by the oblong hole 46*a*. A distance between the developing roller 41 and the photosensitive drum 1 can be changed by rotating or sliding the developing device 4. The change of the distance and motions of the developing device 4 at the time of the rotation and the sliding will be described in detail below.

(6) Methods of Pressurizing and Separating Developing Roller

Figure 8:
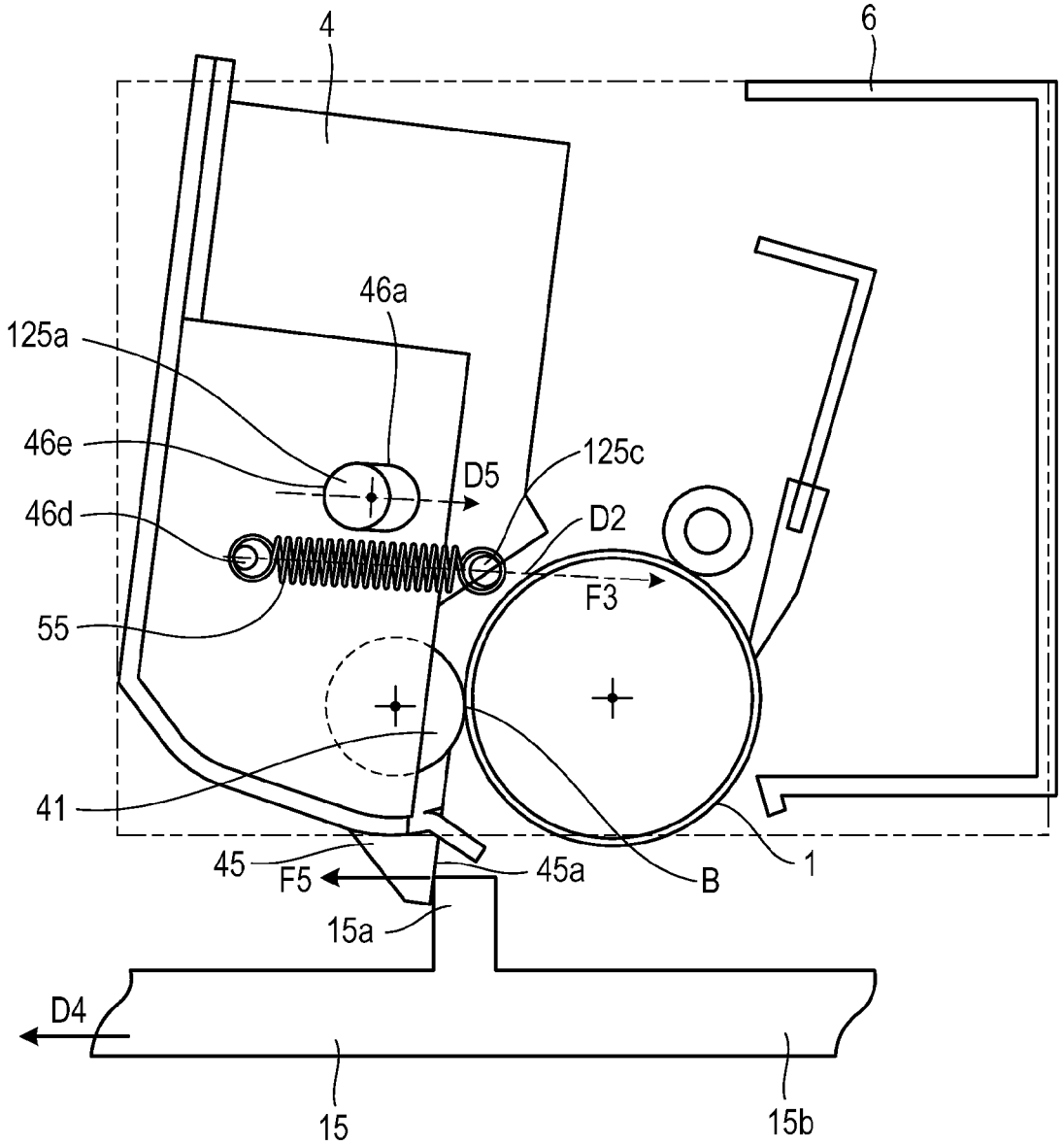
FIG. 8 is a schematic side view illustrating how the developing device is separated from a photosensitive drum.

Next, how the developing device 4 is pressurized according to the embodiment will be described in detail with reference to FIGS. 1, 8, and 9.

Figure 1:
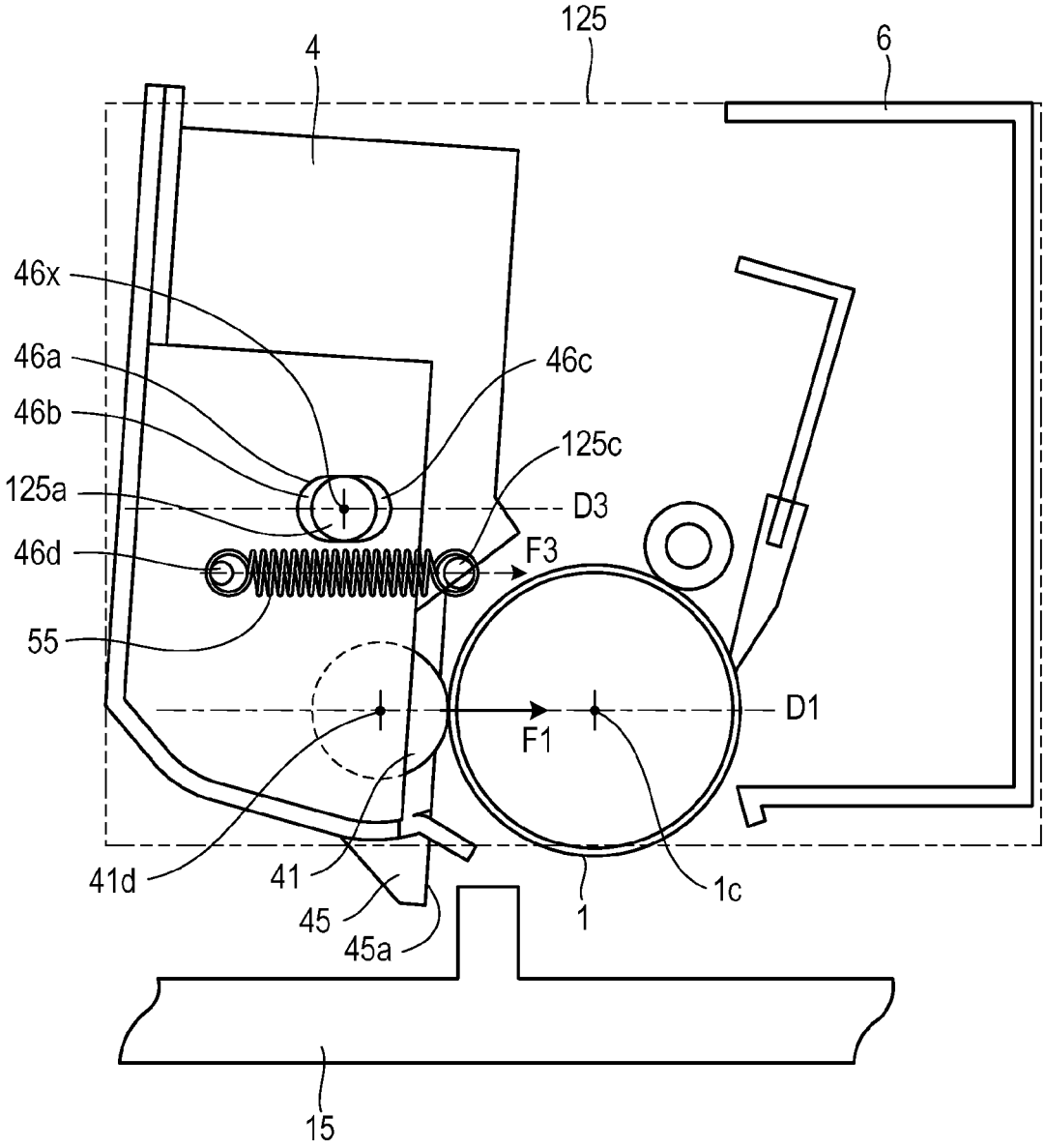
FIG. 1 is a schematic side view illustrating a posture of a developing device at a time when the developing device performs image formation according to an embodiment.

FIG. 1 is a schematic side view illustrating a posture (first position) of the developing device 4 according to the embodiment at the time when the developing device 4 performs image formation. FIG. 8 is a schematic side view illustrating how the developing device 4 is separated from the photosensitive drum 1 as viewed from the non-drive side. FIG. 9 is a schematic side view illustrating a state (second posture) in which the developing device 4 has been separated from the photosensitive drum 1 as viewed from the non-drive side. Note that, in FIGS. 1, 8, and 9, for the sake of convenience of description, the non-drive-side cover member 125 is not illustrated, and partially indicated by the two-dot chain line. Further, in the description below with reference to the drawings, directions, angles, lengths, and the like of the components correspond to those in a projection view (projection plane) orthogonal to the rotary shaft of the developing roller 41.

In the embodiment, in the state illustrated in FIG. 1, a center 46*x* of the oblong hole 46*a* is arranged at the substantially same position as that of a center of the support shaft 125*a*. In addition, a straight line D3 extending in the longitudinal direction (major axis direction) of the oblong hole 46*a* is set to extend in the same direction as that of a straight line D1 connecting a rotation center 1*c* of the photosensitive drum 1 and a rotation center 41*d* of the developing roller 41 to each other. In other words, the straight line D3 and the straight line D1 are (substantially) parallel to each other. Note that, the straight line D1 corresponds to a first straight line, and the straight line D3 corresponds to a second straight line passing through the center of the support shaft 125*a* and being parallel to a slide direction of the support shaft 125*a*.

The non-drive-side bearing member 46 having the oblong hole 46*a* is fixed integrally to the developing device 4.

In the embodiment, a pressurizing spring 55 is provided as a biasing member configured to bias the developing device 4 toward the photosensitive drum 1. In other words, the pressurizing spring 55 applies a biasing force to the developing device 4 so as to bring the developing roller 41 into contact with the photosensitive drum 1.

In the embodiment, an extension spring having one end hooked on a spring hook portion 46*d* provided to the non-drive-side bearing member 46, and another end hooked on a spring hook portion 125*c* provided to the non-drive-side cover member 125 is used as the pressurizing spring 55. Note that, the spring hook portion 46*d* corresponds to an action point at which the biasing force of the pressurizing spring 55 acts on the developing device 4.

In addition, a straight line D2 connecting the two points at which the pressurizing spring 55 is hooked (straight line connecting a center of the spring hook portion 46*d* and a center of the spring hook portion 125*c* to each other) is substantially parallel to the above-mentioned straight line D1 connecting the rotation center 1*c* of the photosensitive drum 1 and the rotation center 41*d* of the developing roller 41 to each other. Note that, the straight line D2 corresponds to a straight line parallel to a direction in which the pressurizing force of the pressurizing spring 55 acts on the spring hook portion 46*d*.

Further, in the embodiment, the pressurizing spring 55 is arranged in a region between the straight line D1 connecting the rotation center 1*c* of the photosensitive drum 1 and the rotation center 41*d* of the developing roller 41 to each other and the straight line D3 extending in the longitudinal direction of the oblong hole 46*a*. A force F3, that is, the pressurizing force (biasing force, or spring force) of the pressurizing spring 55 acts so as to pull the developing device 4 toward the photosensitive drum 1. In the embodiment, the pressurizing spring 55 is arranged in the region between the straight line D1 and the straight line D3, but the embodiment is not limited thereto. The spring hook portion 46*d* at which the biasing force of the pressurizing spring 55 acts only needs to be arranged in the region.

In this state, the oblong hole 46*a* of the developing device 4, into which the support shaft 125*a* of the non-drive-side cover member 125 is fitted, is not regulated by the support shaft 125*a*. With this, the developing device 4 is movable (slidable) with respect to the non-drive-side cover member 125.

In this way, a magnitude F1 of a force (contact force) that causes the photosensitive drum 1 and the developing roller 41 to be held in contact with each other is set to be substantially equal to the force F3 generated by the pressurizing spring 55.

Next, with reference to FIG. 8, how the developing device 4 is separated from the photosensitive drum 1 will be described. The developing device 4 is separated from the photosensitive drum 1 by a force applied from a separation operation portion 15*a* of a separation operation member 15 provided in the image forming apparatus 100. The developing device 4 receives the force at a separation-force receiving portion (receiving portion) 45*a* of the drive-side bearing member 45. In this case, the force for separating the developing device 4 from the photosensitive drum 1 is applied to the developing device 4 against the pressurizing force of the pressurizing spring 55.

In the embodiment, in order to separate the four process cartridges 120 with a single component, the separation operation member 15 is a unitary structure in which four separation operation portions 15*a* are coupled with each other by a coupling portion 15*b*.

When the separation operation member 15, which is out of contact with the separation-force receiving portion 45*a* (FIG. 1), is moved in a direction indicated by the arrow D4 (FIG. 8), the separation operation portion 15*a* is brought into contact with the separation-force receiving portion 45*a* of the drive-side bearing member 45. With this, an actuating force F5 is generated to cause the developing device 4 to be moved in the direction indicated by the arrow D4.

Meanwhile, the force F3 is applied from the pressurizing spring 55 to the developing device 4. With this, the developing device 4 is rotated in the direction D5 about a contact portion B between the developing roller 41 and the photosensitive drum 1. Note that, the oblong hole 46*a* is regulated by the support shaft 125*a*. As a result, the developing device 4 slides along the oblong hole 46*a* until the support shaft 125*a* abuts against a left end 46*e* of the oblong hole 46*a*.

Next, the separation operation member 15 is moved further in the direction indicated by the arrow D4. In conjunction therewith, the separation operation portion 15*a* exerts the actuating force F5 to further move the separation-force receiving portion 45*a*. In this state, the oblong hole 46*a* cannot be moved in the direction D5 any further. Thus, as illustrated in FIG. 9, the entire developing device 4 is rotated about the support shaft 125*a* in the direction D6. In this way, the developing roller 41 is separated from the photosensitive drum 1 by a preset gap E.

In this context, a magnitude of a force that is necessary for separating the developing device 4 will be described.

Figure 9:
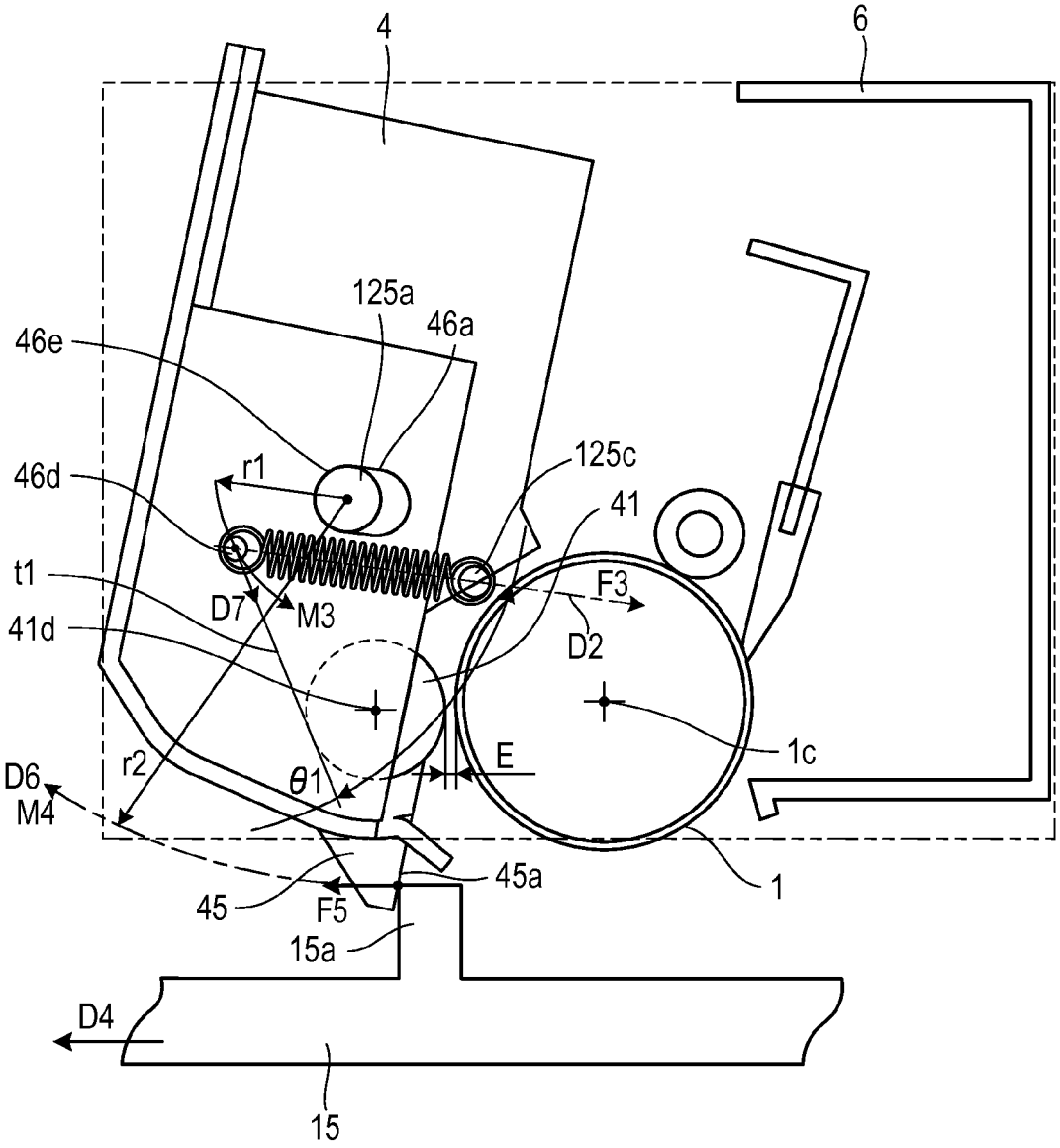
FIG. 9 is a schematic side view of a state in which the developing device is separated from the photosensitive drum.

In the state of FIG. 9, the support shaft 125*a* and the spring hook portion 46*d* are separated from each other by a distance r1. Further, in the state of FIG. 9, an angle θ1 is formed between the straight line D2 and a tangent t1 of an imaginary circle having a radius r1 about the support shaft 125*a*, the tangent t1 passing through the spring hook portion 46*d*.

A moment M3 to be generated by the pressurizing spring 55 at the time of rotating the developing device 4 in the direction D7 (tangential direction of the imaginary circle having the radius r1) is represented by the following expression.

$$M3=F3\cos\theta 1\times r1$$

Meanwhile, a moment M4 to be generated by the separation operation member 15 at the time of rotating the developing device 4 is equal to the moment M3, and is represented by the following expression. Note that, the support shaft 125*a* and the separation-force receiving portion 45*a* are separated from each other by a distance r2.

$$M4=F5\times r2$$

A force F5 necessary for maintaining the state illustrated in FIG. 9, that is, necessary for establishing the relationship that the moment M3 is equal to the moment M4 is represented by the following expression.

$$F5 = F3 \times \cos\theta 1 \times \frac{r1}{r2} \quad \text{Expression 1}$$

In the embodiment, the spring hook portions are arranged so that the angle θ1 is approximately 60°, and that a ratio of the distance r1 and the distance r2 is 1:3.

When this arrangement is applied to Expression 1, the force F5 to be generated by the separation operation member 15 at the time of separating the developing device 4 is represented by the following expression.

$$F5 = F3 \times \cos 60^\circ \times \frac{1}{3} = F3 \times \frac{1}{6}$$

In this way, the force F5 can be reduced down to ⅙ of the actuating force of the pressurizing spring 55 in action.

As understood from Expression 1, as the angle θ1 (θ1<90° is set to be larger, the force F5 can be further reduced. Further, in consideration of an angle to be formed between a line connecting the center of the support shaft 125*a* and the center of the spring hook portion 46*d* to each other and the straight line D2, it is preferred that the angle be set to be smaller than 90°. As the angle is set to be smaller, the force F5 can be further reduced. Further, also by setting the distance r2 to be larger than the distance r1, the force F5 can be further reduced. In addition, also by setting the distance r2 to be larger than a distance from the support shaft 125*a* to the rotation center 41*d* of the developing roller 41, the force F5 can be further reduced.

In this way, the contact force that is necessary for bringing the photosensitive drum 1 and the developing roller 41 into contact with each other is applied, and simultaneously, a force for separating the developing device 4 from the photosensitive drum 1 can be further reduced.

(Modifications)

Now, modifications will be described. In those modifications, only components that are different from those in the embodiment described above will be described, and the components that are the same as those in the embodiment described above are not described.

First, with reference to FIG. 10, a configuration in which an orientation of the oblong hole 46*a* is different from that in the embodiment described above will be described.

Figure 10:
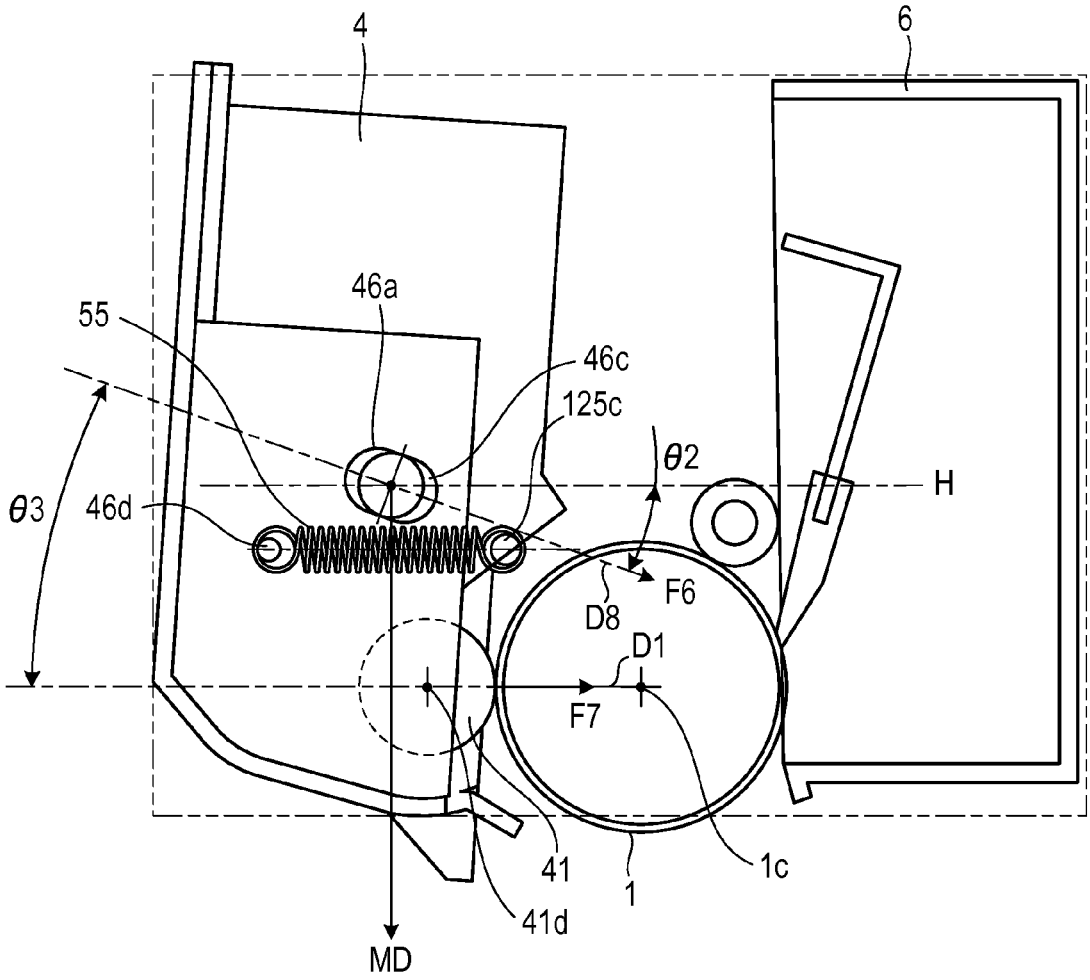
FIG. 10 is a schematic view of a modification.

FIG. 10 illustrates a modification in which the orientation of the oblong hole 46*a* with respect to the straight line D1 is different from that in the embodiment described above.

In the configuration illustrated in FIG. 10, with respect to the straight line D1, a straight line D8 extending in the longitudinal direction of the oblong hole 46*a* is inclined with respect to a horizontal line (horizontal direction) H. Specifically, a side 46*c*, which is closer to the photosensitive drum 1, of the oblong hole 46*a* is inclined vertically downward at an angle θ2 with respect to the horizontal line H. Note that, in FIG. 10, an angle θ3 is formed by the straight line D1 and the straight line D8, and the pressurizing spring 55 is arranged between the straight line D8 and the straight line D1.

The developing device 4 is guided along the oblong hole 46*a* by a weight MD of the developing device 4, and a component force F6 is generated in a direction parallel to the straight line D8.

Then, the component force F6 constitutes a part of a contact force F7 for the developing roller 41 and the photosensitive drum 1. Specifically, the component force F6 of the self-weight of the developing device 4 acts in the direction parallel to the straight line D8 (slide direction) so that the developing roller 41 is brought into contact with the photosensitive drum 1. A magnitude of the component force F6, and a magnitude of the contact force F7 generated by the component force F6 are represented respectively by the following expressions.

$$F6 = MD \times \sin\theta 2$$

$$F7 = F6 \times \cos\theta 3 = MD \times \sin\theta 2 \times \cos\theta 3$$

In this way, when the angle θ2 (θ3) of the oblong hole 46*a* is adjusted, the contact force F7 for the developing roller 41 and the photosensitive drum 1 can be adjusted in accordance therewith. With this, the force of the pressurizing spring 55 can be reduced, and simultaneously, a necessary contact force can be generated. In addition, in accordance with the reduction of the force of the pressurizing spring 55, the force that is necessary at the time of separation can be reduced.

Further, as another modification, a configuration in which an orientation of the pressurizing spring 55 is changed from that in the embodiment described above will be described with reference to FIG. 11.

Figure 11:
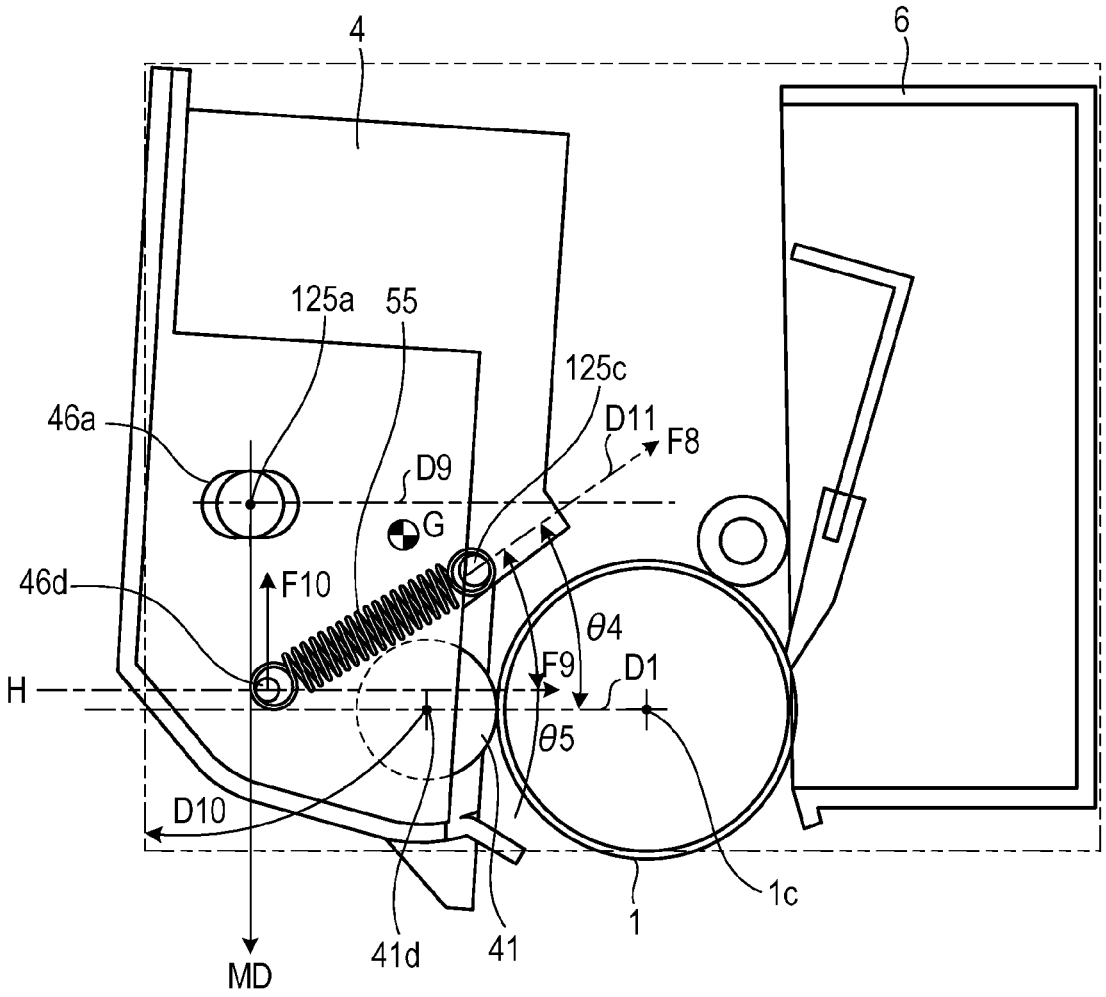
FIG. 11 is a schematic view of another modification.
Figure 12:
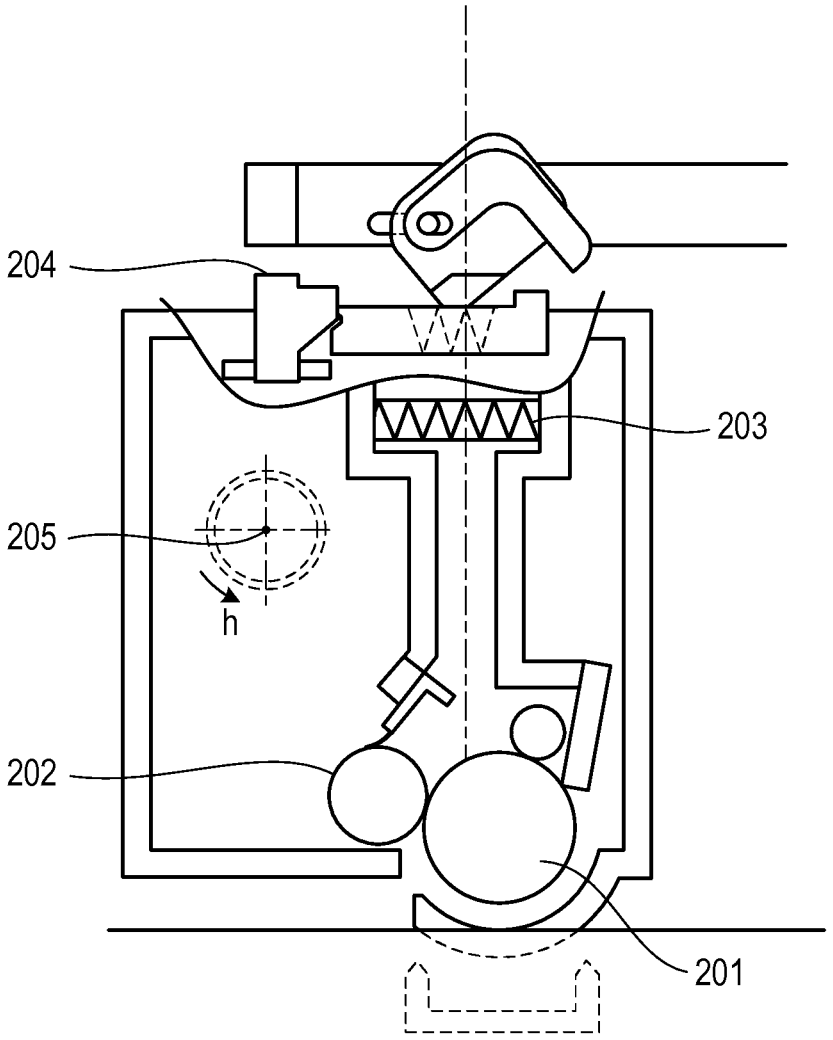
FIG. 12 is a schematic view of the related art.

FIG. 11 illustrates another modification in which the orientation of the pressurizing spring 55 with respect to the straight line D1, that is, the orientation of a straight line D11 connecting the two points on which the pressurizing spring 55 is hooked is different from that in the embodiment described above. The one end of the pressurizing spring 55 is hooked on the spring hook portion 46*d* of the developing device 4, and the another end thereof is hooked on the spring hook portion 125*c* at a position on the straight line D11 which is inclined vertically upward from the spring hook portion 46*d* at an angle θ5 with respect to the horizontal line H. Further, the pressurizing spring 55 is arranged between a straight line D9 extending in the longitudinal direction of the oblong hole 46*a* and the straight line D1.

In this configuration, an angle θ4 is formed by the straight line D1 and the straight line D11. Thus, a contact force F9 for the developing roller 41 and the photosensitive drum 1 is equal to a component force of a force F8 corresponding to the pressurizing force of the pressurizing spring 55. The contact force F9 is represented by the following expression.

$$F9 = F8 \times \cos\theta 4$$

Further, the pressurizing spring 55 generates another component force F10 vertically upward, which is represented by the following expression.

$$F10 = F8 \times \sin\theta 5$$

When the developing device 4 is large in weight, or when a center of gravity G of the developing device 4 is separated from the support shaft 125*a* as illustrated in FIG. 11, the developing device 4 receives a force for rotating the developing device 4 about the support shaft 125*a* in a direction indicated by the arrow D10. The force (moment about the support shaft) is generated by gravity (self-weight of the developing device 4), and acts in a direction in which the developing device 4 is separated from the photosensitive drum 1. The above-mentioned vertically upward component force F10 acts to support the weight of the developing device 4 in a case where the developing device 4 is large in weight or in a state in which the support shaft 125*a* and the center of gravity of the developing device 4 are separated from each other.

With this, the gravity to be applied to the developing device 4 is counterbalanced, and hence the photosensitive drum 1 and the developing roller 41 can be more reliably brought into contact with each other.

Note that, in the case where the developing device 4 is large in weight, a great frictional force is generated between the oblong hole 46*a* and the support shaft 125*a* supporting the developing device 4. In the configuration of FIG. 11, the component force F10 acts to support the weight of the developing device 4. Thus, the frictional force between the support shaft 125*a* and the oblong hole 46*a* is suppressed, and hence the contact force can be more efficiently applied. As a result, unlike the case where the component force F10 does not act, the force of the pressurizing spring 55 need not be increased any further.

In the above-mentioned modifications, the orientation of the oblong hole 46*a* and the orientation of the pressurizing spring 55 are respectively described, but those modifications may be combined with each other. The orientation of the oblong hole 46*a* and the orientation of the pressurizing spring 55 only need to form an angle less than 90° with respect to the straight line D1 (it suffices unless both the orientations are orthogonal to each other). Both the orientations may be selected as appropriate in accordance with design limitation on the developing device.

As described above, according to the embodiment, the support shaft 125*a* configured to support the developing device 4 is provided in a slidable manner, and the spring hook portion 46*d* on which the pressurizing force of the pressurizing spring 55 acts is arranged in the region between the straight line D1 and the straight line D3. With this, the pressurizing force of the pressurizing spring 55 can be caused to efficiently act as a force for bringing the developing roller 41 into contact with the photosensitive drum 1. Meanwhile, at the time when the developing roller 41 is separated from the photosensitive drum 1, the developing roller 41 can be rotated about the support shaft 125*a* as a rotation center. Thus, the force that is necessary for the separation can be set to be small. As a result, the contact force can be sufficiently applied in the state in which the photosensitive drum 1 and the developing roller 41 are in contact with each other, and simultaneously, the developing roller 41 can be separated from the photosensitive drum 1 by a smaller force.

When the force for separating the developing device 4 from the photosensitive drum 1 can be reduced in this way, downsizing and power saving can be achieved in a separation drive part of the image forming apparatus 100. As a result, cost reduction can be achieved.

Further, in the configurations of the related art, when the photosensitive drum 1 and the developing roller 41 are moved from the separated state to the contact state, there is a risk in that significant impact noise is generated at the time when the developing roller 41 contacts the photosensitive drum 1. In the embodiment described above, the force to be applied at the time of transition from the separated state to the contact state can be suppressed in comparison with that in the related-art configurations. Thus, vibration or noise to be generated by the impact at the time of the contact can be further suppressed.

Still further, in the state of FIG. 1, the straight line D1 and the straight line D3 are arranged substantially parallel to each other, and hence the developing roller 41 can be slid substantially parallel to the photosensitive drum 1. In conjunction therewith, when a force of a predetermined magnitude (F3 in the embodiment) is applied between the photosensitive drum 1 and the developing roller 41, the force exerted at the predetermined magnitude can be regarded as the contact force (F1 in the embodiment) (without loss of the force). In addition, the straight line D1 and the straight line D2 are substantially parallel to each other, and hence the force that is necessary as the contact force for bringing the photosensitive drum 1 and the developing roller 41 into contact with each other, and the force to be generated by the pressurizing spring 55 (pressurizing force) can be generated substantially in the same direction. With this, the contact force can be more reliably (efficiently) applied.

Lastly, effects of the embodiment disclosed in the present application can be summarized as follows. According to the embodiment disclosed in the present application, in the cartridge including a contact-separation mechanism for the photosensitive drum and the developing roller, the force that is necessary at the time of separating the photosensitive drum and the developing roller from each other can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-046204, filed Mar. 10, 2014, which is hereby incorporated by reference herein in its entirety.

What is claimed is:

1. A cartridge removably mountable to a main body of an image forming apparatus, the cartridge comprising:

a developing unit having a developing roller configured to perform development in contact with a photosensitive drum;

two support mechanisms each configured to rotatably support the developing unit by a rotary shaft at an each end of both ends of the cartridge in a direction parallel to a rotary shaft of the developing roller; and a biasing member provided on a same side as one of the two support mechanisms with respect to the developing unit, the biasing member being configured to apply a biasing force to the developing unit so as to bring the developing roller into contact with the photosensitive drum, wherein, when a force against the biasing force is applied to the developing unit, the developing unit is rotated about the support shaft so that the developing roller is separated from the photosensitive drum, wherein the one of the two support mechanisms has a bearing configured to hold the support shaft in a manner that the support shaft is slidable in a plane orthogonal to the support shaft, and wherein, in a projection plane, onto which structural members of the cartridge are projected, orthogonal to the rotary shaft of the developing roller, an action point at which the biasing force of the biasing member acts on the developing unit is arranged in a region between a first straight line connecting a rotation center of the developing roller and a rotation center of the photosensitive drum, and a second straight line passing through the support shaft and being parallel to a slide direction of the support shaft.

2. A cartridge according to claim 1, wherein, in the projection plane, the first straight line and the second straight line are substantially parallel to each other.

3. A cartridge according to claim 1, wherein, in the projection plane, the first straight line and a straight line parallel to a direction in which the biasing force acts on the action point are substantially parallel to each other.

4. A cartridge according to claim 1, wherein, in the projection plane, an angle formed by a straight line connecting the support shaft and the action point and a straight line parallel to a direction in which the biasing force acts on the action point is smaller than 90°.

5. A cartridge according to claim 1, wherein the developing unit is provided with a receiving portion configured to receive the force against the biasing force, and wherein, in the projection plane, a distance from the support shaft to the receiving portion is larger than a distance from the support shaft to the action point.

6. A cartridge according to claim 1, wherein the developing unit is provided with a receiving portion configured to receive the force against the biasing force, and wherein, in the projection plane, a distance from the support shaft to the receiving portion is larger than a distance from the support shaft to the rotation center of the developing roller.

7. A cartridge according to claim 1, wherein, in the projection plane, the slide direction is inclined with respect to the first straight line so that the developing roller is pressed against the photosensitive drum by a component force, which acts in the slide direction, of self-weight of the developing unit.

8. A cartridge according to claim 1, wherein a moment about the support shaft caused by self-weight of the developing unit acts in a direction in which the developing roller is separated from the photosensitive drum, and wherein the biasing force of the biasing member has a vertically upward component force.

9. A cartridge according to claim 1, wherein the bearing is provided with an elongated hole, and wherein the support shaft is slidable in a longitudinal direction of the elongated hole.

10. A cartridge according to claim 1, wherein the biasing member comprises an extension spring.

11. A cartridge according to claim 1, further comprising a drive transmission portion configured to transmit a driving force to the developing roller, the drive transmission portion being provided on a same side as another of the two support mechanisms.

12. An image forming apparatus, comprising:

a main body; and a cartridge removably mounted to the main body, wherein the cartridge comprises:

a developing unit having a developing roller configured to perform development in contact with a photosensitive drum;

two support mechanisms each configured to rotatably support the developing unit by a rotary shaft at an each end of both ends of the cartridge in a direction parallel to a rotary shaft of the developing roller; and a biasing member provided on a same side as one of the two support mechanisms with respect to the developing unit, the biasing member being configured to apply a biasing force to the developing unit so as to bring the developing roller into contact with the photosensitive drum, wherein, when a force against the biasing force is applied to the developing unit, the developing unit is rotated about the support shaft so that the developing roller is separated from the photosensitive drum, wherein the one of the two support mechanisms has a bearing configured to hold support shaft in a manner that the support shaft is slidable in a plane orthogonal to the support shaft, and wherein, in a projection plane, onto which structural members of the cartridge are projected, orthogonal to the rotary shaft of the developing roller, an action point at which the biasing force of the biasing member acts on the developing unit is arranged in a region between a first straight line connecting a rotation center of the developing roller and a rotation center of the photosensitive drum, and a second straight line passing through the support shaft and being parallel to a slide direction of the support shaft.

13. An image forming apparatus according to claim 12, wherein, in the projection plane, the first straight line and the second straight line are substantially parallel to each other.

14. An image forming apparatus according to claim 12, wherein, in the projection plane, the first straight line and a straight line parallel to a direction in which the biasing force acts on the action point are substantially parallel to each other.

15. An image forming apparatus according to claim 12, wherein, in the projection plane, an angle formed by a straight line connecting the support shaft and the action point and a straight line parallel to a direction in which the biasing force acts on the action point is smaller than 90°.

16. An image forming apparatus according to claim 12, wherein the developing unit is provided with a receiving portion configured to receive the force against the biasing force, and wherein, in the projection plane, a distance from the support shaft to the receiving portion is larger than a distance from the support shaft to the action point.

17. An image forming apparatus according to claim 12, wherein the developing unit is provided with a receiving portion configured to receive the force against the biasing force, and wherein, in the projection plane, a distance from the support shaft to the receiving portion is larger than a distance from the support shaft to the rotation center of the developing roller.

18. An image forming apparatus according to claim 12, wherein, in the projection plane, the slide direction is inclined with respect to the first straight line so that the developing roller is pressed against the photosensitive drum by a component force, which acts in the slide direction, of self-weight of the developing unit.

19. An image forming apparatus according to claim 12, wherein a moment about the support shaft caused by self-weight of the developing unit acts in a direction in which the developing roller is separated from the photosensitive drum, and wherein the biasing force of the biasing member has a vertically upward component force.

20. An image forming apparatus according to claim 12, wherein the bearing is provided with an elongated hole, and wherein the support shaft is slidable in a longitudinal direction of the elongated hole.

* * * * *